428-919 SR
8/14/84 XR 4,465,731

United States Patent [19]

Pusch et al.

[11] Patent Number: 4,465,731

[45] Date of Patent: Aug. 14, 1984

[54] UNIVERSAL CAMOUFLAGE FOR MILITARY OBJECTS

[76] Inventors: Gunter Pusch, Bannholzweg 12, 6903 Neckargemund 2; Dieter E. Aisslinger, Heidestr. 54, 6222 Geisenheim, both of Fed. Rep. of Germany

[21] Appl. No.: 507,969

[22] Filed: Jun. 27, 1983

[51] Int. Cl.[3] ..... F41H 3/00

[52] U.S. Cl. ..... 428/247; 428/256; 428/919

[58] Field of Search ..... 428/919, 247, 255, 256, 428/304.4

[56] References Cited

U.S. PATENT DOCUMENTS

| | | | |
|---|---|---|---|
| 3,733,606 | 5/1973 | Johansson | 428/919 X |
| 3,977,927 | 8/1976 | Amos et al. | 428/919 X |

FOREIGN PATENT DOCUMENTS

| | | | |
|---|---|---|---|
| 1034070 | 7/1958 | Fed. Rep. of Germany | 428/919 |
| 1035529 | 7/1958 | Fed. Rep. of Germany | 428/919 |
| 1404121 | 8/1975 | United Kingdom | 428/919 |

*Primary Examiner*—Henry F. Epstein
*Attorney, Agent, or Firm*—Michael N. Meller

[57] ABSTRACT

A camouflage material whose convective heat exchange pattern simulates the thermal properties of a natural background and having a non planar surface comprising a mesh support, a conductive layer on said support and an outer layer on said conductive layer containing metallic material and having an emissivity in the wave length of far infrared of about 20 to 70% and wherein said outer layer comprises a synthetic foam layer.

12 Claims, 9 Drawing Figures

FIG. 3
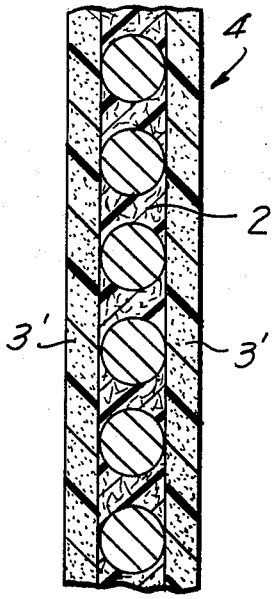
FIG. 4a
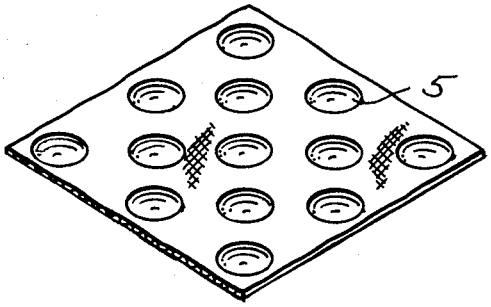
FIG. 4b
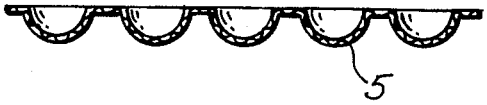
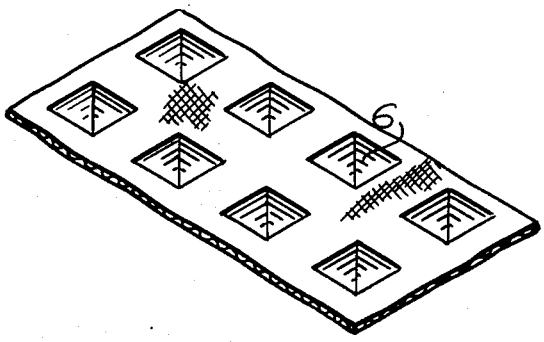
FIG. 5a
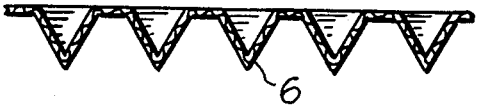
FIG. 5b
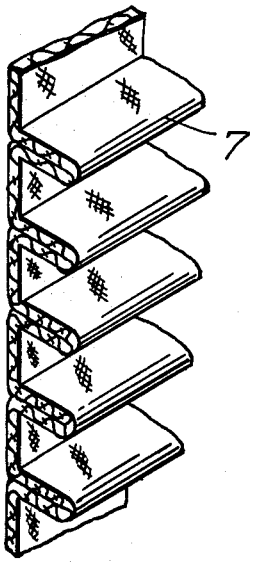
FIG. 6

UNIVERSAL CAMOUFLAGE FOR MILITARY OBJECTS

BACKGROUND OF THE INVENTION

Advanced technology of detection requires more sophisticated camouflage devices for military purposes than heretofore. Today camouflage devices must be effective in the visible, near infrared, thermal infrared and radar regions of the spectrum to prevent recognition or identification of military targets.

Camouflage articles usually consist of supporting nets and clipped on colored garnishing, textile-like material. This type of camouflage material produces successful results only in the visible and near infrared regions of the spectrum. In order to protect against radar detection, metal fibers have been incorporated into the base textile material. The incorporation of an electrically conductive layer in the garnishing material improves the effectiveness against radar identification.

In order to change the emission factor in the infrared region, an attempt was made to adjust the emission to simulate the natural background emission coefficient as described in Pusch et al, application Ser. No. 459,354, filed Dec. 16, 1982, by providing a metallic reflective layer and a camouflage paint which contains pigments having reflective properties in the visible and near infrared regions of the spectrum similar to those of a natural background. Since the conductive layer also serves as a reflective layer for the thermal infrared region of the spectrum, the conductive layer is bifunctional. However, a disadvantage of this arrangement is that the conductive and/or reflective layer does not exhibit constant performance when under usage stress. In addition, the camouflage material is affected by solar radiation and does not behave the same as natural foliage. Under these circumstances, the camouflage does not blend into the natural background.

Grasses and leaves have specific temperature control arrangements not only depending on the emission coefficient. The temperature control system in nature is quite complicated. Part of the absorbed solar energy is used in photosynthesis. The rest of the absorbed energy is transferred to the ambient air by means of molecular water evaporation. Many plants change the incident angle of solar radiation by changing the leaf position to avoid overheating by solar radiation.

SUMMARY OF THE INVENTION

It is the object of the invention to provide convective heat exchange in the camouflage materials of the prior art in order to simulate the thermal properties of the natural background. This object is accomplished by increasing the effective surface of the camouflage material.

A mesh is provided with a conductive layer having a conductivity of 2 to 50 ohms per square to protect against radar detection and then with an outer layer having an emissivity of about 20 to 70%. This outer layer consists of a coating of an open cell foam or a paint, each containing a leafing metal pigment. To increase the convective effectiveness of the material, the mesh is constructed so that the ratio of the width of the space between two filaments to the width of one filament is about 1 to 0.5 to 1 to 3. The convective effect may be increased by providing corrugations or zig zag folds in the material or by providing it with radiation fins, thus further increasing the effective surface area.

This construction provides a cover for military targets and acts as a thermal diffuser. It may be substituted as a mechanical means of strength for the previously used and necessary basic carrier net.

On top of this basic construction patches of specifically constructed and coated fabric are mounted in order to simulate the structure of plants, trees and foliage as generally found in nature.

To increase the surface of these patches, they are embossed or corrugated to a high extent in order to enhance the heat exchange to the ambient air.

BRIEF DESCRIPTION OF THE DRAWINGS

FIG. 3 is a partial cross section of a second embodiment of a mesh according to the invention.

FIG. 4*a* is a perspective view of one embossed pattern on the surface of the camouflage material of FIG. 3.

FIG. 4*b* is a cross sectional view of the pattern of FIG. 4*a*.

FIG. 5*a* is a perspective view of a second embossed pattern on the surface of the camouflage material of FIG. 3.

FIG. 5*b* is a cross sectional view of the pattern of FIG. 5*a*.

FIG. 6 is a partial perspective view of radiation fins.

DETAILED DESCRIPTION

Figure 1:
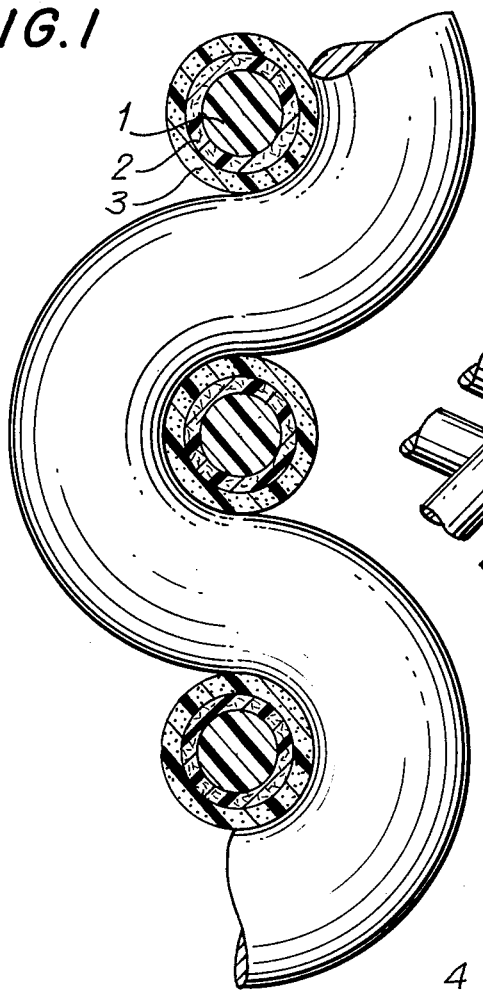
FIG. 1 is a partial cross sectional view of a mesh according to the invention.
Figure 2:
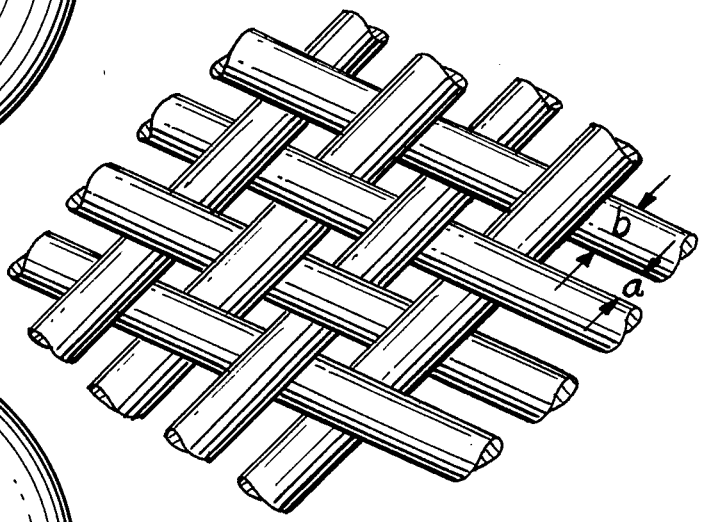
FIG. 2 is a partial perspective diagrammatic view of the mesh filaments.

FIG. 1 shows a mesh 1 which may replace a conventional support net and on which a conductive layer 2 is applied by means of impregnation technique. This layer is made conductive by using a phenol resin binder containing about 10 to 50% of an electrically conductive pigment, such as graphite or lamp black. On top of this usually black-appearing coating, a foam plastisol is applied by dipping and subsequently foamed and cured to an open cell foam top layer 3. In order to increase the surface for convective heat transfer, the ratio of the width of the space between two filaments to the width of one filament of the mesh is about from 0.5 to 1 to 1 to 3, as shown in FIG. 2. The mesh may be welded, knitted or just a layered mesh where the binding is done by subsequent treatment.

The layers 2 and 3 do not constitute a complete cover for the mesh. The holes increase the convective heat exchange to the ambient air and the open cell foam structure increases the effective surface area. In order to adjust the emissivity to the natural environment, layer 3 contains about 5 to 25% metal pigment to yield an emissivity of about 20 to 70% of the black body. In this new construction the net behaves like a diffuser. This means that hot spots with clear and sharp contours enlarge to bigger unclear contours with lower specific intensity when the radiation from the hot spots passes through the diffuser.

A second embodiment of the improved camouflage material according to the invention as shown in FIG. 3 has the woven textile material coated with a conductive layer of the same formulation as described above. Both sides are coated with a paint containing leafing metallic pigments to provide about 20 to 70% emissivity in the thermal infrared region compared with the emissivity of an ideal black body.

A further improvement is to emboss the woven textile material in order to enlarge the convective surface area. FIGS. 4*a, b* and 5*a, b* show hemispherical and pyramidal embossing patterns, respectively. Embossing produces an enlargement of the surface area and enhances the convective heat transfer to the ambient air. Embossing of textiles is very common. It is effected by passing the textile between male and female engraved rollar nips under pressure.

A further improvement lies in forming the conductive mesh from thin filaments. The filaments can be made as follows. A thin aluminum foil of 6 to 20 μm in thickness is laminated between two thin polyester films having a thickness of 6 to 20 μm and then cut into endless filaments having a width of about 0.2 to 0.5 mm. These metallic filaments can be used as a substitute for providing the conductive layer in the mesh or fabric or may be used in conjunction therewith.

Non-metallic filaments for the mesh may consist of polyester, nylon, polyethylene, polypropylene or other commercially available fibers. The phenol resin binder used for the conductive layer may be any of the commercially available phenol-formaldehyde resins. Examples of the conductive pigments used in the conductive layer are lamp black, aluminum, graphite and the like.

Foam plastisols which may be used in the top layer as shown in FIG. 1 may consist of polyurethane, polyolefins, polyvinyl chloride, polyethers, polyesters, polystyrene and polyacrylates, which may be cured in the conventional way. The metal pigments which are incorporated into the top layer of foam or paint may be copper, zinc or steel, preferably aluminum, of the leafing type.

The binder for the paint may include cyclorubber, polyethylene, polypropylene or other binders transparent in the infrared range of the spectrum.

Conventional pigments used in camouflage materials may be used for the colored sheets which may be affixed onto the mesh. Examples of such pigments are chromium oxides, iron oxides, titanium dioxide, mineral pigments, such as sienna, chalk and ultramarine blue.

Figure 7:
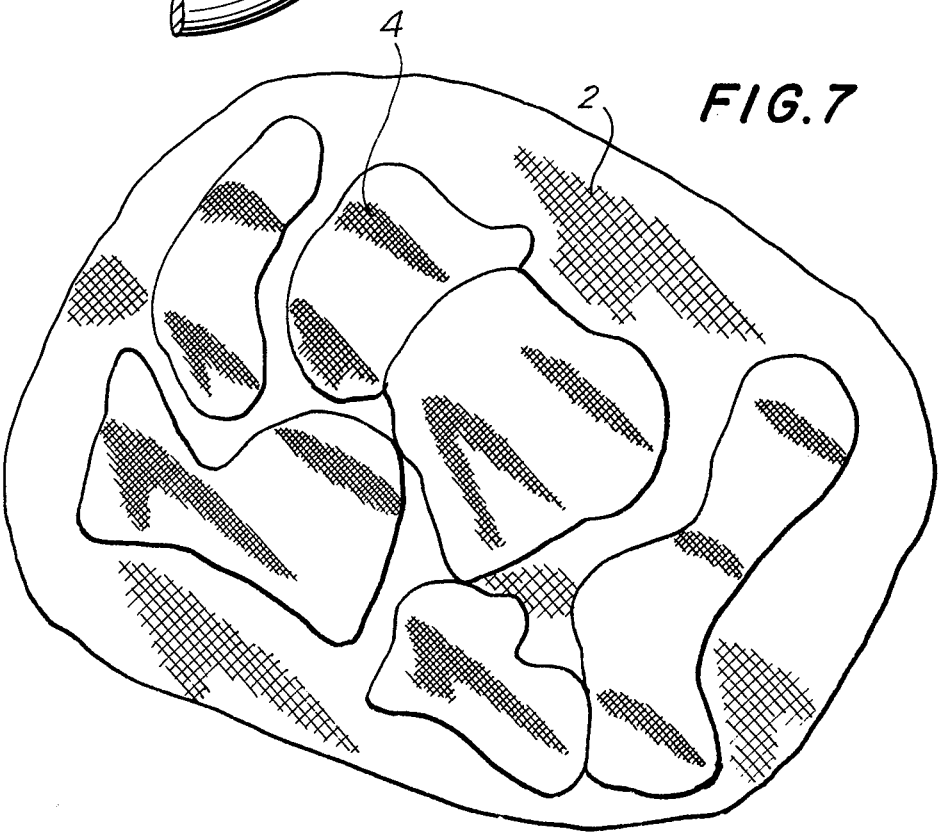
FIG. 7 is a partial diagrammatic view of an assembly of the mesh of FIG. 1 having attached patches of camouflage material of FIG. 3, optionally embossed or provided with radiation fins as in FIGS. 4, 5 and 6.

Further improvements are achieved by fixing irregular shaped patches of woven fabric 4 on top of the coated mesh 2 in the manner as shown in FIG. 7.

The woven fabric is cut into irregular shaped patches which are fixed to the treated basic mesh in order to imitate natural structure as well as give more partial coverage to the thermal emission of the object to be camouflaged.

The surface of the woven fabric can be improved for convectional heat exchange by incising the plain or the embossed fabric prior to fixing to the mesh treated according to the invention.

EXAMPLE 1

A mesh made of polypropylene monofilaments with a diameter of about 0.5 mm is coated with a conductive lacquer of about 50 gr/m$^2$ weight containing from 12 to 20% lamp black, or graphite or mixtures thereof. The conductive layer can be applied by spraying, roller coating or squeeze rolling. After drying to remove solvents, the mesh with the remaining conductive layer then is dipped into a plastisol of 55% PVC and 45% phthalate plasticizer containing color and metal pigments. After curing of the plastisol to form a foam layer, some woven textile patches 4 are clipped on. The textile patches 4 are based on a woven textile material of approximately 12 threads per cm, both sides having been coated by a knife blade or any other suitable technology, in order to cover the textile surface evenly with a conductive layer coating similar to that used on the mesh. On top of this coating, another coating containing infrared reflecting pigments is applied in suitable colors in the visible range of the spectrum.

Further improvement is achieved by embossing the textile 4 prior to fixing to the mesh. This can be done economically by reeling through an embossing calender with male and female engraved roller nips. The patches may have different colors by incorporating pigments as already disclosed in the copending application of Pusch et al, Ser. No. 459,354 filed Dec. 16, 1982.

EXAMPLE 2

Instead of using polypropylene filaments for the mesh in Example 1, polyester filaments are used. The conductive coating contains aluminum and the foam plastisol is a pre-whipped acrylate emulsion. To improve the conductivity in the high frequency radar range, some conductive metallized filaments, as already described, are used in the base textile material.

While there has been described in the above examples the principles of this invention, it is to be clearly understood that the examples and the foregoing description is not to be interpreted as a limitation to the scope of the invention as set forth more particularly in the objects thereof and is to be limited merely by the subsequent claims.

We claim:

1. A camouflage material whose convective heat exchange pattern simulates the thermal properties of a natural background and having a non planar surface comprising a mesh support, a conductive layer on said support, said conductive layer having a conductivity of 2 to 50 ohms per square and an outer layer on said conductive layer containing metallic material and having an emissivity in the wave length of far infrared of about 20 to 70%, and wherein the ratio of the width of the space between two filaments to the width of each filament in the mesh is about 1 to 3.

2. The camouflage material of claim 1, wherein said outer layer comprises an open-cell synthetic foam layer.

3. The camouflage material of claim 2, wherein said foam layer comprises a material selected from the group consisting of polyurethane, polyolefins, polyvinyl chloride, polyethers, polyesters, polystyrene and polyacrylates.

4. The camouflage material of claim 1, wherein said outer layer comprises a paint applied in patches.

5. The camouflage material of claim 4, wherein said paint comprises pigments to obtain color in the visible part of the spectrum which also functions in the near infrared region of the spectrum, metal pigments to reflect in the far infrared region and a binder which is substantially transparent to infrared radiation.

6. The camouflage material of claim 1, having an embossed surface.

7. The camouflage material of claim 1, having patches of fabric attached thereto.

8. The camouflage material of claim 7, wherein said patches of fabric comprise a textile material, a conductive layer on said textile material and a paint having an emissivity in the wave length of far infrared of about 20 to 70% on both sides of said material.

9. The camouflage material of claim 4, having an embossed surface.

10. The camouflage material of claim 1, further comprising radiation fins.

11. The camouflage material of claim 9, further comprising radiation fins.

12. The camouflage material of claim 1, wherein at least part of the filaments of the mesh have a width of about 0.2 to 0.5 mm and comprise a yarn obtained by lamination of aluminum foil having a thickness of about 6 to 20 μm between polyester films each having a thickness of about 6 to 20 μm.

* * * * *